US005184375A

United States Patent [19]

Hoyt

[11] Patent Number: 5,184,375

[45] Date of Patent: Feb. 9, 1993

[54] SCORE CARD HOLDER

[76] Inventor: David Hoyt, 1136 West 135th St., Gardena, Calif. 90247

[21] Appl. No.: 832,943

[22] Filed: Feb. 10, 1992

[51] Int. Cl.[5] ..... A45F 5/00

[52] U.S. Cl. ..... 24/3 L; 24/3 J; 24/11 PP; 24/11 CT; 224/247

[58] Field of Search ..... 24/3 L, 3 R, 3 J, 3 D, 24/3 F, 11 PP, 11 CT, 67.11, 338, 339; 224/247, 248, 252

[56] References Cited

U.S. PATENT DOCUMENTS

| | | | |
|---|---|---|---|
| 556,209 | 3/1896 | Quinn | 24/3 J |
| 1,484,321 | 2/1924 | Brouillette et al. | 24/3 J |
| 1,692,712 | 11/1928 | Tannebaum | 24/3 J |
| 3,597,802 | 8/1971 | White | 24/11 CT |
| 3,968,546 | 7/1976 | Seaborn et al. | 24/67.11 |
| 3,983,602 | 10/1976 | Barry | 24/3 R |
| 4,100,652 | 7/1978 | Carlson | 224/247 |
| 4,157,152 | 6/1979 | Blastic | 24/11 PP |
| 4,830,248 | 5/1989 | Pommenville | 224/247 |
| 5,077,869 | 1/1992 | Haase | 24/3 L |

*Primary Examiner*—Victor N. Sakran

[57] ABSTRACT

Disclosed is a device for holding a score card. It has three pieces: (1) a rigid, generally rectangular, planar support member having an edge portion, an inside surface, and an outside surface, and (2) a clip member 14 secured along the edge portion of the support member 12, and (3) a hook member 28. The support member has dimensions slightly greater than the dimensions of the score card and a cut-a-way corner section, and the clip member 14 is a unitary structure made from a polymeric material. It has three main components: a mounting section 24, a finger element 26, and a pencil holder 30. The mounting section 24 abuts and is secured to the inside surface 22 of the support member 12 adjacent the edge portion of the support member. The finger element 26 extends outwardly in a first direction from the mounting section 24, and has a downward extending tip section 34 which is spaced from the mounting section 24 to provide a narrow gap A which receives the edge portion of the support member. The tip section 34 overlaps the support member along the edge portion, extending along substantially the entire length of the edge portion of the support member. The tip section 34 is biased to act like a spring to bear against the outside surface 20 of the support member. Upon inserting an edge of the score card between the tip section 34 and the outside surface 20 of the support member, the finger element 26 holds the score card snugly between the tip section 34 and the outside surface. The hook member 28 extends outwardly from the inside surface of the mounting member 12 in a second direction which is generally opposite to the first direction. The hook member 28 is adapted to slip over and grasp an open mouth of a club holding receptacle of a golf bag. The pencil holder 30 extends in the second direction outwardly from the mounting member 24 and is positioned between the hook member 28 and the tip section 34 of the support member adjacent the cut-a-way corner section 18.

6 Claims, 3 Drawing Sheets

FIG. 1
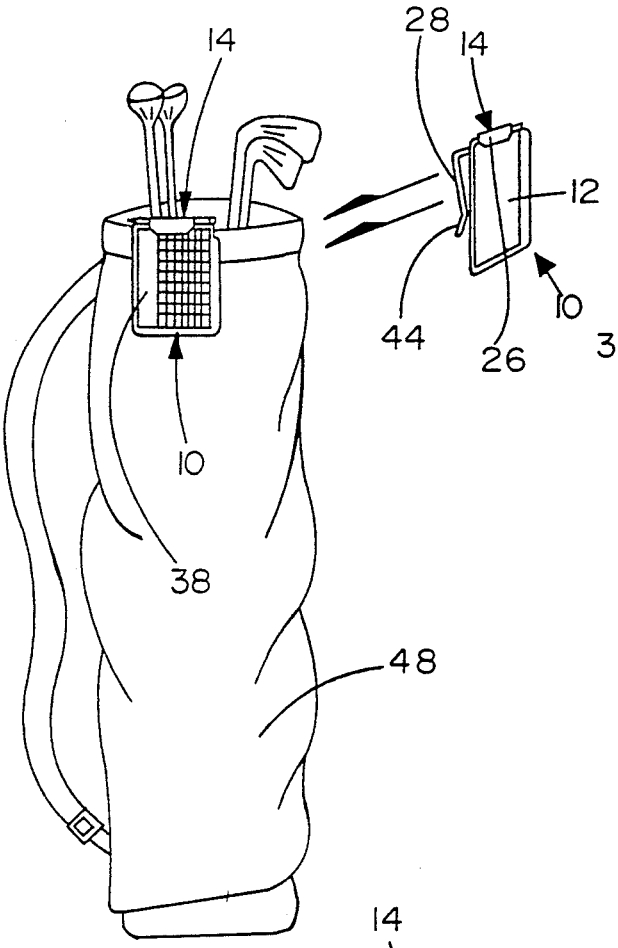
FIG. 2
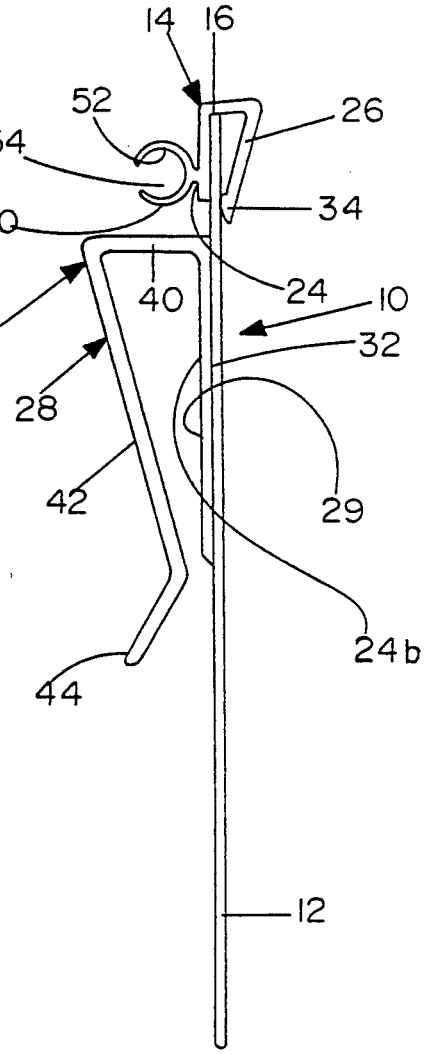
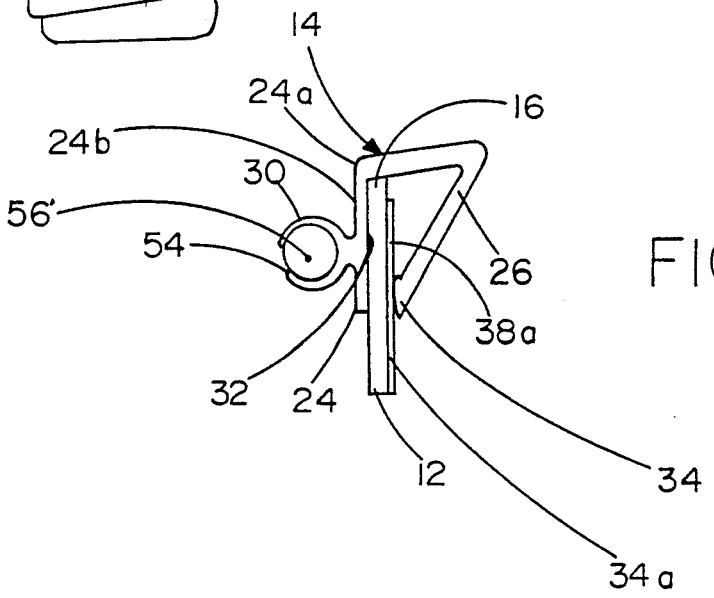
FIG. 2A

SCORE CARD HOLDER

BACKGROUND OF THE INVENTION

1. Field of the Invention

This invention relates to a device for holding a score card or the like. It includes only three pieces: a support member for the card so that the card may be written upon; a clip attached to the support member that removably holds the card by an edge; and a hook member which enables the device to be removably attached to the rim of, for example, a golf bag.

2. Background Discussion

Score cards are utilized in many different sporting activities, and it is desirable to provide devices which hold the card and allow one to easily mark the card. In the sport of golf, it is desirable that the holder be removably attached to the golf bag. Such devices should be rugged, easy to use, and simply and economically manufactured. The present invention provides such a score card holder.

SUMMARY OF THE INVENTION

The score card holder of this invention has several features, no single one of which is solely responsible for its desirable attributes. Without limiting the scope of this invention as expressed by the claims which follow, its more prominent features will now be discussed briefly. After considering this discussion, and particularly after reading the section entitled, "DETAILED DESCRIPTION OF THE PREFERRED EMBODIMENT," one will understand how the features of this invention provide its advantages, which include low cost of manufacture, convenience of use, compactness, and rugged construction.

The first feature is the score card holder has only three pieces. One piece is a rigid planer support member, a clip member secured to the support member along an edge portion of a support member for holding a score card or the like, and a hook member adapted to grasp a rim or an edge. The clip member is a unitary structure including a finger element and a pencil holder.

The second feature is that the planer support member has a generally rectangular configuration with dimensions slightly greater than the dimensions of the score card. One corner of the support member is cut away. This cut-away section provides access to the pencil holder.

The third feature is that the mounting section abuts and is secured to the inside surface of the support member adjacent to the edge portion of the support member. The finger member extends outwardly in a first direction from the mounting section. This finger element has a downward extending tip generally at a right angle. The tip is spaced from the mounting section to provide a narrow gap which receives the edge portion of the support member. Thus, the tip overlaps the support member along the edge portion.

The fourth feature is that the tip extends along substantially the entire length of the edge portion of the support member. It is biased to act like a spring which bears against the outside surface of the support member so that, upon inserting the edge of the score card between the tip and the outside surface, the tip holds the score card snugly against the outside surface of the support member.

The fifth feature is that the hook member extends outwardly from the inside surface of the support member in a second direction opposite to that of the finger element. The hook is adapted to slip over and grasp, for example, the open mouth of a club-holding receptacle of a golf bag.

The sixth feature is that the pencil holder, which is also extending outwardly from the mounting member in the same direction as the hook member, is positioned near the hook member adjacent the cut-away corner section.

The seventh feature is that the pencil holder is generally a hollow, cylindrical member with opposed open ends and a longitudinal slit therein that allows the holder to expand upon inserting a pencil into one of the open ends. The pencil holder is oriented so that the longitudinal axis of the holder is generally parallel to the edge portion of the support member.

As a result of the configuration of the clip member and the way it and the hook member are attached to the support member, a compact, rugged, easy to assemble and use score card holder is provided.

BRIEF DESCRIPTION OF THE DRAWING

The preferred embodiment of this invention, illustrating all its features, will now be discussed in detail. This embodiment depicts the novel and non-obvious score card holder of this invention depicted in the accompanying drawing, which is for illustrative purposes only. This drawing includes the following figures (FIGS.), with like numerals indicating like parts:

FIG. 1 is a perspective view of the score card holder of this invention attached to the rim of a golf bag.

FIG. 2 is a side elevational view of the score card holder of this invention, showing the unique configuration of the clip member.

FIG. 2A is an enlarged, fragmentary side elevational view of the tip of the clip member with a score card being grasped by the tip.

DESCRIPTION OF THE PREFERRED EMBODIMENT

Figure 3:
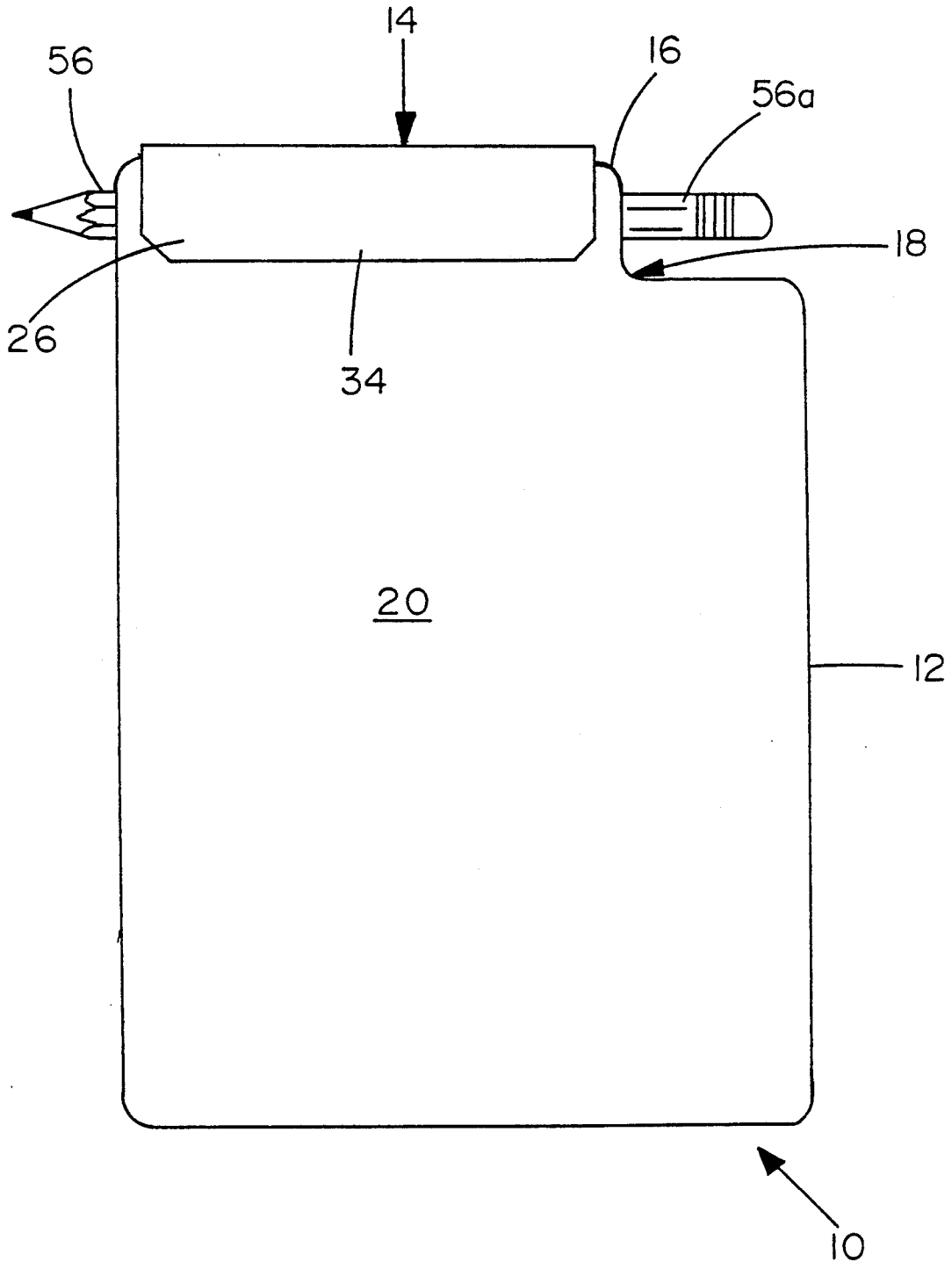
FIG. 3 is a top plan view of the score card holder of this invention.
Figure 4:
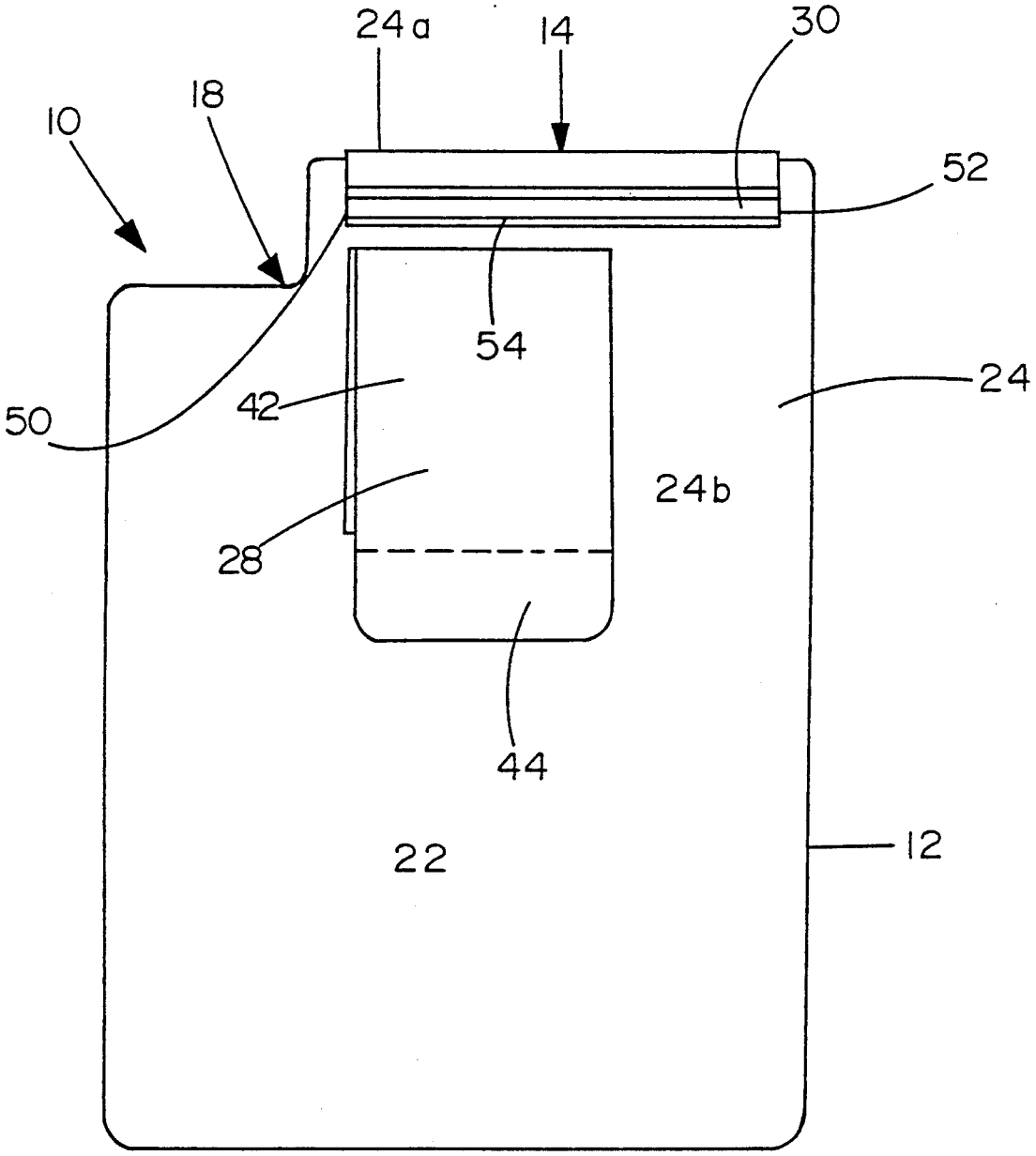
FIG. 4 is a rear plan view of the card holder of this invention.

As best illustrated in FIGS. 2 through 4, the score card holder 10 of this invention includes a rigid, generally rectangular support panel 12, and a clip member 14 secured to the support panel 12 along an upper edge 16 of the panel, and a hook member 28. The clip member 14 and hook member 28 are injection molded pieces made preferably of polystyrene or ABS resin.

The support panel 12 has a generally rectangular configuration with a cut-away corner section 18 (FIGS. 3 and 4). The panel 12 has an outside surface 20 and inside surface 22, both of which are flat and smooth. The width of the panel 12 is approximately four inches, the height of the panel is approximately five and three-quarters inches, and the upper edge 16 of the panel has a length of approximately two and one-half inches. The cut-away section 18 has dimensions of approximately three-quarters of an inch in height, and one inch in width. The thickness of the panel 12 is approximately 0.080 inch.

The clip member 14 has a generally rectangular mounting section 24, a finger element 26, and a pencil holder 30, all of which are integral, being formed during the injection moulding process. The mounting section 24 has its inner surface 32 abutting the inside surface 22 of the panel 12. These abutting surfaces 22 and 32 are bonded together by an adhesive. The finger element 26, which is at the upper edge 24*a* (FIG. 2A) of the mounting section 24, extends outwardly from the mounting section away from the inner surface 32. The finger element 26 includes a downward extending tip section 34. The lower end 34*a* of the tip section 34 is beveled, and spaced apart from the mounting section 24 to provide a narrow gap A between the inner surface 32 and the tip section 34. This gap A has a width slightly less than the thickness of the support panel 12. The upper edge portion 16 of the support panel 12 upon being inserted into the gap A pushes the tip section 34 away from the mounting section 24 so that the tip section 34 is spring-biased and bears snugly against the outside surface 20 of the panel. Thus, an edge 38*a* of a score card 38 may be easily pushed between the tip section 34 and the outside surface 20 so that the tip section 34 will flex outwardly and then bear against the score card and hold it in place. The rigid panel 12 provides support for the score card 38 so that one may write upon the score card.

The hook member 28 includes a mounting plate 29 which is bonded by an adhesive to the inside surface 22 of the support panel 12. Pointing outwardly from the mounting plate 29 in a direction generally opposite to the direction of the finger element 26 is a hook arm 31 of the hook member 28. This hook arm 31 has an outwardly extending arm 40 (FIG. 2) and a downward extending leg 42 which has a lip 44 that projects outwardly. The overall height of the leg 42 is approximately two and one-half inches, and the arm 40 is approximately three-quarters of an inch below the upper edge 16 of the panel 12. The hook member 28 acts like a spring and allows the user to simply slip the hook member over the rim of a golf bag 48 as illustrated in FIG. 1. The hook member 28 will flex outwardly and grasp the wall of the golf bag 48 snugly to removably attach the holder 10 to the golf bag.

The pencil holder 30 is disposed between the hook member 28 and the finger element 26. This pencil holder 30 comprises a generally hollow, cylindrical member with opposed, open ends 50 and 52 and a longitudinal slit 54 in its wall. Thus, a pencil 56 may be conveniently inserted through either open end 50 or 52, with the cylindrical wall expanding upon insertion of the pencil into the pencil holder 30. As depicted in FIG. 3, a pencil 56 is shown with an end portion 56*a* being exposed because of the cut-away corner section 18.

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiment disclosed. On the contrary, the intention is to cover all modifications and alternate constructions coming within the spirit and scope of the invention as generally expressed by the following claims, which particularly point out and distinctly claim the subject matter of the invention:

I claim:

1. A device for holding a card, including a rigid, planar support member having an edge portion, an inside surface, and an outside surface, and a clip member secured along the edge portion of the support member, and having a mounting section which abuts and is secured to the inside surface of the support member adjacent said edge portion of the support member, a finger element extending outwardly in a first direction from the mounting section and overlapping said edge portion to extend outward from the outside surface, said finger element having a downward extending tip section which is spaced from the mounting section to provide a narrow gap into which the edge portion of the support member fits so the tip section overlaps the support member along said edge portion, said tip section being biased to act like a spring which bears against the outside surface of the support member and, upon inserting an edge of the card between the tip section and the outside surface of the support member, is adapted to hold the card snugly between said tip section and said outside surface, said tip section extending along substantially the entire length of the edge portion of the support member, and a pencil holder extending outwardly from the mounting member in a second direction which is generally opposite to said first direction, said pencil holder being on the side of the support member opposite that of the finger element, and being between the hook member and the tip section, a hook member extending outwardly from the inside surface in a second direction which is generally opposite to said first direction, said hook member being adapted to slip over and grasp an edge of a container.

2. The device of claim 1 where the pencil holder is near the hook member.

3. The device of claim 2 wherein the pencil holder is a generally hollow cylindrical member with opposed open ends and a longitudinal slit therein that allows the cylindrical member to expand upon inserting a pencil into one of the open ends.

4. The device of claim 1 where the support member has a generally rectangular configuration with a cut-a-away corner section along said edge portion adjacent the pencil holder.

5. The device of claim 1 where the support member has dimensions slightly greater than the dimensions of a typical score card used when playing golf.

6. A device for holding a gold score card, including a rigid, generally rectangular, planar support member having an edge portion, an inside surface, and an outside surface, said support member having dimensions slightly greater than the dimensions of the score card and a cut-a-way corner section, and a clip member secured along the edge portion of the support member, said clip member being a unitary structure made from a polymeric material and having a mounting section which abuts and is secured to the inside surface of the support member adjacent said edge portion of the support member a finger element extending outwardly in a first direction from the mounting section, said finger element having a downward extending tip section which is spaced from the mounting section to provide a narrow gap into which the edge portion of the support member fits so the tip section overlaps the support member along said edge portion, said tip section extending along substantially the entire length of the edge portion of the support member and being biased to act like a spring which bears against the outside surface of the support member and, upon inserting an edge of the score card between the tip section and the outside surface of the support member, is adapted to hold the score card snugly between said tip section and said outside surface, and a pencil holder extending in a second direction outwardly from the mounting member and positioned between a hook member and the tip section of the support member adjacent the cut-away corner section, said pencil holder being a generally hollow cylindrical member with opposed open ends and a longitudinal slit therein that allows the cylindrical member to expand upon inserting a pencil into one of the open ends, and being oriented so that the longitudinal axis of the holder is generally parallel to the edge portion of the support member the hook member extending outwardly from the inside surface of the support member in said second direction which is generally opposite to said first direction, said hook member being adapted to slip over and grasp an open mouth of a club holding receptacle of a golf bag.

* * * * *